United States Patent [19]

Grof et al.

[11] 4,049,039

[45] Sept. 20, 1977

[54] METHOD AND APPARATUS FOR THE PRODUCTION OF SOLID FORGING BLOCKS WITH MANIPULATOR PINS

[75] Inventors: Helmut Theodor Gröf, Brouchkobel; Jochen Schumann, Maintal; Anton Wamser; Rainer Schumann, both of Hanau am Main; Werner Friedrich Thomas, Hasselroth, all of Germany

[73] Assignee: Leybold-Heraeus GmbH & Co. Kg, Cologne, Germany

[21] Appl. No.: 732,962

[22] Filed: Oct. 15, 1976

[30] Foreign Application Priority Data

Dec. 6, 1975 Germany ..... 2554959

[51] Int. Cl.[2] ..... B22D 19/00; B22D 27/02

[52] U.S. Cl. ..... 164/52; 164/252; 164/98

[58] Field of Search ..... 164/52, 98, 112, 252, 164/332; 249/136

[56] References Cited

U.S. PATENT DOCUMENTS

| | | | |
|---|---|---|---|
| 2,651,668 | 9/1953 | Southern | 164/252 X |
| 2,792,605 | 5/1957 | Smith | 164/112 |
| 3,129,473 | 4/1964 | Veil, Jr. | 164/252 |
| 3,908,736 | 9/1975 | Cooper | 164/52 |

FOREIGN PATENT DOCUMENTS

| | | | |
|---|---|---|---|
| 1,380,467 | 1/1975 | United Kingdom | 164/52 |

*Primary Examiner*—Ronald J. Shore
*Attorney, Agent, or Firm*—Joseph F. Padlon

[57] ABSTRACT

An arrangement for the manufacture of solid forging blocks with manipulator pins in which an electro-slag remelt process is used for filling an ingot having a vertical bore hole. At least one consumable electrode is used, and the ingot with the vertical bore is placed on a block table having at least one power connection in the region of the block table and flush with a depression for slag start material. The filling of the core zone is started with this depression having a depth of substantially at least 25% of the diameter of the block bore. A movable starting disk is applied as a lower boundary of the depression, and the slag start material is placed on top of the disk. After formation of liquid slag, the depression is exclusively filled from material of the consumable electrode. The power connection to the starting disk is fed along during the entire remelt process.

10 Claims, 2 Drawing Figures

METHOD AND APPARATUS FOR THE PRODUCTION OF SOLID FORGING BLOCKS WITH MANIPULATOR PINS

BACKGROUND OF THE INVENTION

The present invention relates to a method and means for the manufacture of solid forging blocks with manipulator pins by filling an ingot provided with a borehole by the electro-slag remelt process with at least one consumable electrode. The ingot with the vertical borehole is placed on a block table with at least one power connection in the region of the block table and flush with a depression for the slag start material, and the filling of the core zone occurs starting at this depression.

In the manufacture of steel forging blocks there occrus the hazard, as the block diameter increases, that there may appear, in the core zone, structural defects which may lead to the rejection of the block involved. It is already known in the art how to perforate large-diameter ingots, removing the core zone, and to fill the resulting hollow space (cavity) in accordance with the initially described procedure by the electroslag process without defects (German Patent, No. 2,122,306 and German Laid-Open Document 2,403,843).

In the last-mentioned publication (2,403,843), in view of the starting phase of the known procedure, it is recommended that the bottom plate be provided with a recess in which the starting material, comprising metal shavings and slag, be placed and then ignited and molten by means of a permanent electrode. After a while, the recess is filled with liquid steel which is withdrawn from the perforated ingot. This results in a material loss, even though small, flawless block material is involved.

The recess in the bottom plate is extremely flat and extends also in the radial direction underneath the retained part of the ingot, forming dead corners in which unmolten slag is enclosed by the steel melt. The resulting extension is not only too small for a manipulator pin; its volume is not sufficient to accommodate all slag not molten during the cold start so that a part of the ingot base must be cut off and discarded before further processing. Then a new manipulator pin must be made by forging to facilitate further process of the ingot.

A major problem is the supply of the melting current to the perforated ingot. Its underside has considerable unevennesses and tinder layers which do not ensure sufficient melting current supply. Hence the melt parameters, in an extremely undesirable manner, are subject to great fluctuations which are detrimental to a homogeneous structure. The steel, first liquid and collecting in the recess of the bottom plate and then solidified, by itself would ensure good current transfer. However, this possibility is eliminated because the material in the recess, due to the solidification and cooling process, is subject to a strong cross- and lengthwise contraction so that the metallic contact in the recess, required for current transfer, is interrupted after a short time interval.

It is, therefore, an object of the present invention to provide a process and an apparatus by means of which, without additional measures, a manipulator pin can be produced on forging blocks during the manufacturing process, and by means of which a trouble-free transfer of the melting current during the starting phase and the subsequent remelt phase is made possible.

SUMMARY OF THE INVENTION

The objects of the present invention are achieved by providing that the depth of the depresion is at least 25%, preferably 40% of the diameter of the block borehole, with a movable starting disk being used as lower boundary of the depression and the slag starting material being placed on top of it. After formation of liquid slag, the depression is exclusively filled from the material of the melt-off electrode and the power connection to the starting disk is being fed along during the entire remelt process.

It is understood that the diameter of the depression essentially is identical with the diameter of the ingot borehole, with deviations of ±20% being acceptable.

Without additional measures, the following advantages are achieved: due to the special depth dimension of the depression, one obtains a manipulator pin of sufficient length. One should observe the tendency that with very large block diameters or bore diameters, one operates in the lower region near the stated limiting values, while with smaller block diameters one also may choose depths which are 70, 80 or even 100% of the diameter of the block borehole. As a result, the depression has a vastly increased volume relative to the present state of the art. This volume can accommodate all slag remainders not molten during the starting phase, so that the entire bottom part of the finished block (ingot) can be used without restriction. Even the so-called "hydrogen peak" is limited to the manipulator pin forming in the depression, so that the production is considerably increased. In particular, the "base loss" typical of an electro-slag remelt process is virtually completely avoided.

At the beginning of the remelt process, the movable starting disk is fused with the ingot core building up on it, so that, in conjunction with the measure to feed the power connection to towards the starting disk during the entire remelt process, a trouble-free continuous current transfer is assured. The formation of the manipulator pin exclusively from the material of the consumable electrodefurther increases the continuity of the process. The reason is that the material for the manipulator pin need not be taken from the perforated ingot whose bottom edge, because of the depth of the depression is considerably above the lower boundary of the depression. When using a permanent electrode, this material loss would be difficult to compensate.

The feeding of the power connection towards the starting disk is accomplished in a most simple fashion by connecting the starting disk via a flexible lead to the associated pole of the power source. The feeding is accomplished automatically in that the shrinking manipulator pin drags the starting disk fused to it along with it in the upward direction. The statement that at least one power connection is in the area of the block table includes the above measure since the starting disk, which is a consumed part which must be continually renewed, must be considered as belonging to the block table for the duration of a remelt process.

An apparatus for implementing the procedure in accordance with the present invention ordinarily comprises an electrode holding and feeding device with power connection and a block table with a power connection of opposite polarity. In the block table, a depression for accommodating the slag starting material and for starting the remelt process is provided. Such an apparatus, in accordance with the present invention's improvement has the feature that the depth of the depression is at least 0.25 times, but preferably 0.4 times the diameter of the depression, with the wall of the depression essentially having a cylindrical form, and that the bottom of the depression comprises a closure plate movable in the vertical direction relative to the block table. The power connection is attached to the closure plate.

The expression "substantially cylindrical", in contrast with the state of the art, defines a geometrical form which permits the suspension of the manipulator pin from a chain or clamping by a manipulator set of pliers, without having to be afraid of sliding off. For reasons of free withdrawal of the manipulator pin, the depression preferably should have a slightly conical shape, with the deviation from the cylindrical form being hardly noticeable (of the order of 2°).

The closure plate is expediently adapted to the inside cross-section at the lower end of the depression, i.e., it has a circular contour. Both block table and depression and closure plate have double walls and are liquid-cooled (water-cooled). Of course, it is possible to use the closure plate itself as injection disk and to make it from steel, so that it is a consumed part and must be replaced every time. It is particularly expedient to make the closure plate from the same material as block table and depression, from copper, and to mount on it a special starting disk, so that the closure plate can be reused as often as desired. For this purpose, the closure plate is provided with means for the electrically conducting mounting of the special starting disk. These devices are described in detail in the secondary claims so that a detailed description at this point is not required. by clamping the starting disk, which must be made of a material with a smooth surface, with the closure plate, one gets a current path of very low contact resistance which is retained by the feeding of the closure plate during the entire remelt process.

The use of pressure medium drives as tension elements, using hooklike elements, leads to a rapid disconnection of the starting disk; the required contact pressure between injection disk and closure plate can be influenced by varying the pressure.

It is particularly expedient to have the depresion for the formation of the manipulator pin to be formed by the hollow space of a pot which is interchangeable in the block table. Through the interchangeability it is possible to place into an opening in the block table pots with different diameters and depths which correspond to the block borehole inside diameter being used at that time. It is only necessary to provide each of the interchangeable pots with a flange rim of the same outside diameter. This universality of the apparatus, which is not available with the present state of the art, create the possibility of an individual adaptation of the depression to the dimensions of the perforated block to be processed. In this manner, the formation of possible dead corners underneath the block (ingot) bottom side can be reliably circumvented.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
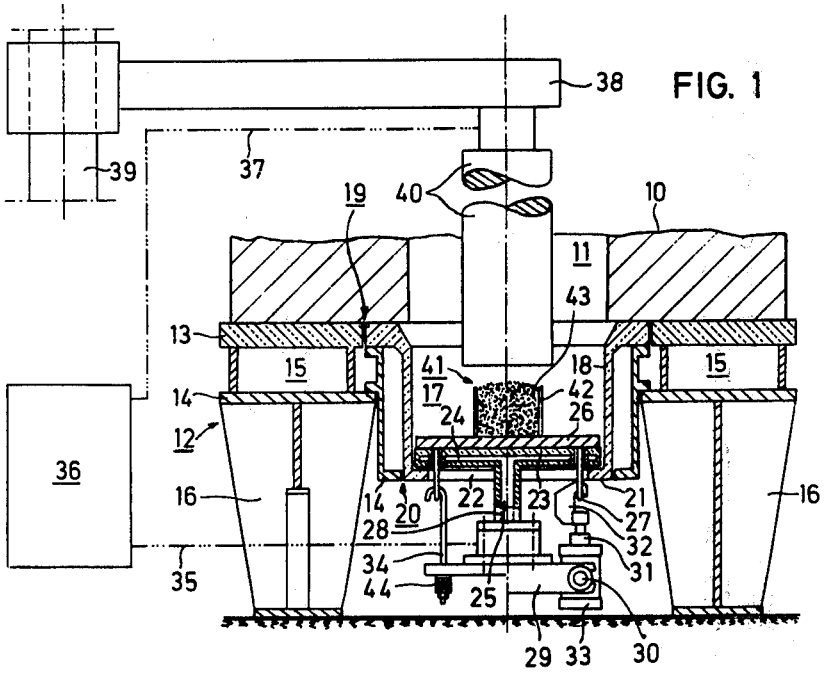
FIG. 1 is a vertical section through the bottom part of the perforated block and the block table with suspended consumable electrode at the beginning of the starting process in conjunction with a schematic diagram of the electrode holding and feeding apparatus.

FIG. 1 shows the bottom part of an ingot 10 whose core has been removed in the direction of the longitudinal axis by perforation, resulting in a block borehole 11. The ingot 10 rests on a block table 12 whose outside dimensions correspond to the largest block to be processed. The block table 12 comprises a planar copper plate 13, having a cooling jacket 14 and producing a cavity 15 through which water can be circulated. The block table 12 rests on several supporting brackets 16 distributed over the periphery and forming a peripheral ring.

In the center of the block table 12 and flush with the block borehole 11 is a depression 17 formed by the cavity of a pot 18 which can be replaced in the block table 12. The jacket part of the pot 18 has an extremely slight conical shape with a taper angle of 2° and therefore can be considered virtually cylindrical. It is replaceably inserted into the copper plate 13 and into the cooling jacket 14 through separating gaps 19 and 20, using conventional sealing means.

The pot 18 at its underside has an inward directed flange rim 21 which surrounds a central opening 22. On the flange rim in the state of rest there lies a closure plate 23 which, like pot 18, is made of copper and is two-walled, forming a hollow space 24 for carrying a coolant. The hollow space 24 is connected via an intake and outlet 25 with a coolant connection. For the sake of simplicity, only one of the lines is shown, running through the opening 22 from thepot 18. It is evident that the closure plate 23 virtually completely fills or closes the inside cross-section of pot 18 at the narrowest point, but is freely movable by a considerable amount in the upward direction.

On the closure plate 23, there rest a starting disk 26 with almost congruent dimensions. The starting disk is provided with tie rods 27 which pass through corresponding liquid-tight passages in the closure plate 23 and through the opening 22 in the space beneath it. The intake and outlet line 25 runs inside a pressure member 28 which at its bottom end has a traverse 29 on which several attaching points 30 are located. The number of attaching points corresponds to the number of tie rods 27. To the attaching points 30 there are connected tension elements 31 which engage the tie rods 27, for example, by means of a hook 32 as shown to the right of the axis of symmetry. As tension element 31, one may use a pressure medium drive 33 or an analogous draw-in bolt or draw spindle 34 as shown to the left of the axis of symmetry. For example, it is also possible to secure the tie rods 27 to the closure plate 23 through wedges, eccentric disks, etc.; an elastic intermediate link is of advantage. When using draw-in bolts, it is advantageous to use spring elements betweenthem and the traverse. In this manner, the injection disk 26 is connected to the closure plate with good conductance and permanently.

Via the pressure member 28, the closure plate is connected to a flexible power connector 35 which leads to a power source 36. A second power connector 37 of opposite polarity leads to an electrode holding and feeding device 38 which is located on an electrode bearing column 29 and can be moved, at least in the vertical direction. The electrode holding and feeding device 38 holds the upper end of a consumable electrode 40 which, at the beginning of the starting process, projects through the block borehole 11 and concentric with the latter into the depression 17. At a slight distance underneath the electrode 40, on the starting disk 26 is the slag start material 41 which comprises a sheet metal container 42 and a mixture 43 of steel shavings and slag.

The mode of operation of the device shown is as follows: first, by lowering the consumable electrode 40 and the resulting closure of the circuit, the slag start material is "ignited", melting the slag of mixture 43 and granulated slag located outside the sheet metal container 42. The depression 17 gradually fills with molten slag, rising from below, through which the current path between electrode 40 and starting disk 26 remains closed. Increasingly, the material of the consumable electrode 40 melts and collects underneath the slag layer, displacing the latter gradually upward. As a result, the depression 17 is gradually filled with material from the consumable electrode 40, with this material solidifying from below, fusing with the starting disk 26 and from the sidewalls of pot 18. In this manner, one forms the so-called manipulator pin which may also contain inclusions of non-molten slag and other impurities, without objectionable effects.

Approximately at the moment at which the depression 17 is filled with the material of the consumable electrode 40, the material at the inside surface of block borehole 11 starts to participate in the remelt process, with the block borehole 11 being gradually filled with the material of the consumable electrode in the upward direction, as is already kknown from the publications mentioned earlier.

The manipulator pin in the depression 17, because of increasing cooling, is subject to a crosswise and lengthwise contraction which, after a solidified metallic connection between the manipulator pin and the ingot 10 raises the bottom surface of the manipulator pin in the upward direction. Due to the fusion of the manipulator pin with the starting disk 23 and to the bracing of the injection disk 26 with the closure plate 23 and the power connector 35, these parts follow the upward movement (several centimeters) of the bottom side of the manipulator pin so that the current path remains closed. Closure of the circuit is maintained during the entire remaining meltclosed process. After terminating this process, only tension elements 31 are released so that the fused-close ingot 10 and the manipulator pin integral with it can be lifted from the block table or from the depression 17. The apparatus (fixture) is immediately ready for a new starting disk 26.

Figure 2:
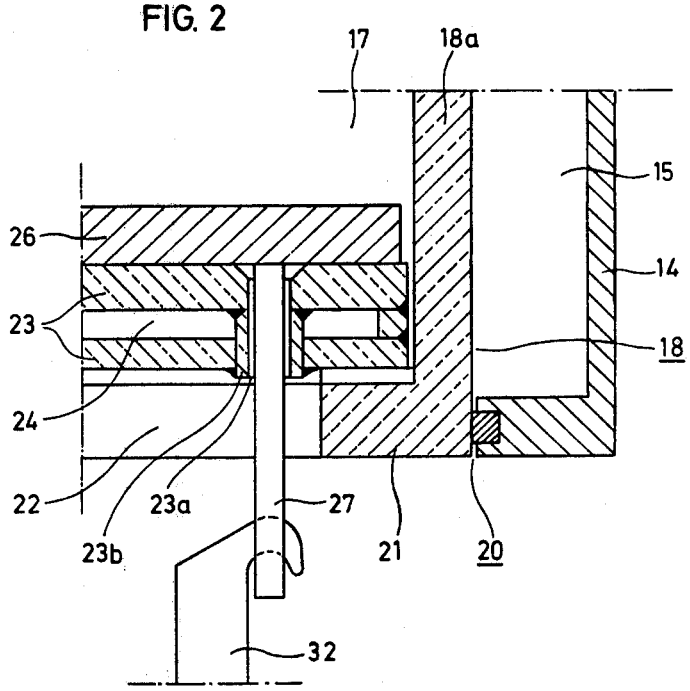
FIG. 2 shows an enlarged section of the overall-arrangement of FIG. 1 in the region of the depression for the manipulator pin, the closure plate and the injection disk.

In FIG. 2, identical parts from FIG. 1 have the same reference numerals. One can identify the closure plate placed loosely in pot 18; its downward movement is restricted by the flange rim 21, but it can follow without restriction the starting disk 26, which during the shrinkage of the manipulator pin is pulled upward, in the region of interest here. FIG. 2 also shows the sealing at the separating gaps 20 and the passage of tie rod 27 mounted on the starting disk 26. Passage **23*a* provided for this purpose in the closure plate if formed by a sleeve 23*b* which is connected liquid-tight to the wall elements of closure plate 23. In this manner, the starting disk 26 with the tie rod 27, after removal of hook 32, can be lifted from the closure plate. The sealing of wall 18*a* of pot 18 from cooling jacket 14** is clearly shown.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention, and therefore, such adaptations should and are intended to be comprehended within the meaning and range of equivalence of the following claims.

We claim:

1. In a method for the manufacture of solid forging blocks with manipulator pins wherein an ingot having a vertical borehole is filled by an electro-slag remelt process with at least one consumable electrode, the improvement comprising placing the ingot with the vertical borehole on a block table with at least one power connection in the region of said block table and with the vertical borehole of the ingot aligned with a depression in the block table for slag start material, the depth of the depression being at least 25% of the diameter of the ingot borehole, applying a a movable starting disk as lower boundary of the depression; placing the slag start material on top of said disk; filling after formation of liquid slag said depression exclusively from materialof said consumable electrode; and feeding a power connection to the starting disk along during the entire remelt process.

2. Apparatus for carrying out the method according to claim 1, comprising in combination: electrode holding and feeding means with a power connection; a block table having a power connection of opposite polarity; said block table having a depression for holding slag start material and for the start of the remelt process, the depth of said depression being at least 0.25 times the diameter of said depression; the wall of said depression having a cylindrical shape; a closure plate at the bottom of said depression and movable in vertical direction relative to said block table; the power connection of said block table being attached to said closure plate.

3. The apparatus as defined in claim 2 wherein said closure plate comprises a starting disk.

4. The apparatus as defined in claim 2 including starting disk means for fastening to said closure plate; and means for electrically conductive fastening of said starting disk means to said closure plate.

5. The apparatus as defined in claim 4 including tie rods fastened to said starting disk, said closure plate having passages for said tie rods; and tensional elements insertable into said tie rods and acting against said closure plate.

6. The apparatus as defined in claim 5 including a pressure member, said tensional elements comprising pressure medium drives with fastening points facing said tie rods and being connected to a traverse extending underneath and parallel to said closure plate, said fastening points being connected thereto via said pressure member.

7. The apparatus as defined in claim 5 including a pressure member, said tensional elements comprising draw-in bolts with fastening points facing said tie rods and being connected to a traverse extending underneath and parallel to said closure plate, said fastening points being connected via said pressure member to said closure plate.

8. The apparatus as defined in claim 7 including spring means between said draw-in bolts and said traverse.

9. The apparatus as defined in claim 7 including pot-shaped receptacle means for forming said depression and replaceable in said block table, the hollow space of said pot-shaped receptacle comprising said depression.

10. The apparatus as defined in claim 2 wherein said depression has a depth of substantially 0.4 times the diameter of said depression.

* * * * *